US006227943B1

(12) United States Patent
Garant et al.

(10) Patent No.: US 6,227,943 B1
(45) Date of Patent: May 8, 2001

(54) METHOD AND SYSTEM FOR PRE-CLEANING AND POST-CLEANING DEPOSITED METAL

(75) Inventors: John J. Garant, Hopewell Junction; Charles H. Perry, Poughkeepsie; Srinivasa S. N. Reddy, Lagrangeville; Donald R. Wall, Poughkeepsie, all of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/071,411

(22) Filed: May 1, 1998

(51) Int. Cl.[7] ..... B24C 1/04
(52) U.S. Cl. ..... 451/40; 451/57; 451/29
(58) Field of Search ..... 451/40, 29, 57, 451/38, 54, 78; 427/290, 444

(56) References Cited

U.S. PATENT DOCUMENTS

| | | | | |
|---|---|---|---|---|
| 4,113,899 | * | 9/1978 | Henry et al. | 427/290 |
| 4,451,505 | | 5/1984 | Jans . | |
| 4,664,942 | * | 5/1987 | Park | 427/57 |
| 4,679,359 | | 7/1987 | Suzuki . | |
| 4,965,173 | | 10/1990 | Gould . | |
| 5,330,879 | | 7/1994 | Dennison . | |
| 5,527,203 | | 6/1996 | Cook et al. . | |
| 5,531,841 | | 7/1996 | O'Melia et al. . | |

* cited by examiner

*Primary Examiner*—Robert A. Rose
(74) *Attorney, Agent, or Firm*—James Cioffi, Esq.; McGinn & Gibb, PLLC

(57) ABSTRACT

A method and system for cleaning an object containing a metal surface, includes pre-cleaning the object to prepare the object for a metal plating thereover, and post-cleaning the object after the object has been plated with the metal plating. The pre-cleaning step and the post-cleaning step each include blasting the object with a media.

22 Claims, 2 Drawing Sheets

1
6
7
8
9
10
11
12
13

METHOD AND SYSTEM FOR PRE-CLEANING AND POST-CLEANING DEPOSITED METAL

BACKGROUND OF THE INVENTION

1. Field of the Invention

The present invention generally relates to a method and system for cleaning a deposited metal, and more particularly to a method and system for pre-cleaning and post-cleaning a deposited nickel.

2. Description of the Related Art

In ceramic packaging technology, it has been found that refractory metals, such as tungsten and molybdenum, are not directly brazable or solderable due to their surface wettability. Generally, the external terminal refractory metal features, such as, pads and vias, must first be plated with a metal which is brazable and solderable and which can also be made to bond with molybdenum and tungsten. Usually, nickel is used as the plating metal. The common processes used for plating external features with nickel are electroplating and electroless plating in a wet bath (a so-called "wet process").

However, besides these two common "wet" plating processes (e.g., electroplating and electroless plating), a relatively new process has been developed which plates electrolessly a nickel or nickel alloy film via a dry chemical vapor deposition (CVD) process. Nickel or nickel alloy deposited in such a manner is referred to as "Dry Process Nickel" (DPN). Variations of this method are disclosed in U.S. Pat. No. 4,664,942 and in U.S. patent application Ser. No. 08/668,295, by Reddy et al., filed on Jun. 21, 1996 and assigned to International Business Machines Corporation, and the disclosure of both is incorporated herein by reference. Generally, the DPN process is a unique operation with specific attributes that are different than standard wet plating processes.

Most applications of the DPN plating involve ceramic substrates for packaging semiconductors. Traditionally, external refractory metal features of ceramic substrates have been plated with nickel using low temperature wet plating baths (e.g., with electroless nickel boron or nickel phosphorus, or electroplated nickel).

In either case, (e.g., a high temperature dry process or a low temperature wet process), the substrate surface must be cleaned appropriately and processed both before and after the respective plating step. Key contaminates which may affect the substrate surface in any plating process include extraneous metal, glass or other nonmetallic ceramic particles, such as, alumina, metal oxide, and other contaminates, such as, organic contaminates or carbonaceous residue. Each of these is addressed briefly below.

Extraneous metal is a difficult problem in substrate manufacture.

Specifically, refractory metal particles may reside on the surface of a substrate where they are not supposed to be. These particles originate from various sources including contamination in screening and lamination, and also from debris in the sintering kiln. It is very difficult, if not impossible, to completely eliminate these contaminate refractory metal particles in the manufacturing process. Therefore, these particles must be removed in subsequent processing. Generally, the particles are about 1–2 microns in size, and they are usually embedded in the surface pores of the ceramic substrate by the time the substrate has completed sintering.

Glass is usually part of the ceramic insulator, and is added intentionally to the green sheet that forms the product. Glass provides for viscous flow sintering of the ware at temperatures well below what would be required if the glass were not present. Additionally, the glass serves several other important purposes.

For example, during sintering, the glass will flow and infiltrate the via or pad. Specifically, the interface which secures the I/O pads is the glass, with "glass fingers" being formed by the glass flowing during the sintering operation. In this step, the I/O pads become securely bonded to the fired substrate. This is done basically by the glass in the pad reflowing and making contact with the glass in the substrate to form "finger links", to secure the electrical conductive pad to the ceramic substrate. However, the glass may completely (and erroneously) cover external metal features. The presence of glass on the conductive terminal features constitutes a defect, and must be removed before the plating of the terminal feature is initiated.

Similarly to glass, ceramic particles, such as alumina particles, are usually present in the metallic paste purposely, and some of these particles become exposed at the surface of the terminal metallic feature in a fired substrate. Additionally, ceramic particles may be scattered as debris over the surface of a part originating from various sources. These particles are often referred to as "fused ceramic", because they may become fused to the surface of a substrate, either metal or ceramic area, during sintering of the product.

Metal oxide is oxidation that will normally occur to a metal surface forming a thin oxide film or skin when the metal surface is exposed to an oxidizing environment. For example, even air at room temperature can be a source of terminal feature oxidation. Removal (or at least minimization) of the oxide can be a significant contributor to a plating operation's success.

Carbon debris may originate from handling or from any of a plurality of sources. Post-sintering, all organic debris should be reduced to carbonaceous residue. However, recontamination of a substrate with organic debris is an ongoing concern. Oftentimes, organic contamination will result in surface stains that disqualify the part. Additionally, carbon residue on terminal features will severely retard wettability and substrate quality, and consequently affect reliability. Organic contamination must be removed and/or avoided.

For the traditional nickel plating of electroless nickel boron or nickel phosphorous, or electroplated nickel, the extraneous refractory metal particles are removed from the substrate surface prior to plating by a complex set of chemical etches. Usually, these chemical etches include potassium ferricyanide, boiling KOH, HCL solutions, and the like. The ferricyanide dissolve the extraneous particle enough so that it is subsequently removed. The other chemical treatments prepare the terminal features for plating. If the extraneous refractory metal particles are not removed from the substrate surface prior to electroless plating, then they will plate during the plating step with nickel. For the electroless wet nickel plating, these particles will aggressively bridge to each other the plated metal creating shorts between terminal features.

For the electroplated part, the extraneous metal particles will not plate because they are electrically isolated. However, the substrate will be left with exposed refractory metal particles on its surface. This condition is unacceptable to part quality and to subsequent processing steps. Therefore, etching the refractory metal particles off the substrate surface prior to electroplating is a reasonable option.

Current pre-cleaning and post-cleaning for the DP nickel plating process also require the same complex chemical etching described above to remove extraneous refractory metal particles.

Additionally, another problem arising for post-cleaning substrates plated with DP nickel is that the plating process may detach and float nonmetallic particles associated with the metallic feature on the substrate surface, such as, for example, alumina particles, such that the nonmetallic particles will remain at the top of the feature even after it is fully plated. These particles having been floated up normally are covered or coated when using traditional plating processes such as electroless nickel boron or nickel phosphorous or electroplated nickel, and therefore are covered by the nickel plating and are of no additional concern. However, for the DP nickel plating process, these particles are problematic, and, like other nonmetallic contaminates, will degrade the wetting properties of the plated nickel film. Hence, these particles must be removed.

Currently, for DP nickel plated parts, these undesirable particles are removed, post-DPN plating, such as, by hand scrubbing each part with a brush. While hand-scrubbing is most effective in removing the undesired particles and leaving the soft, fully annealed nickel plated film undisturbed, this is a labor-intensive process and very costly. Recently, an attempt was made to replace this hand scrubbing process with a jet of water or spray. However, the particles are adhered too strongly to the substrate surface and will not be satisfactory removed by spray alone.

Thus, pre-cleaning and post-cleaning methods are performed for the DPN process. However, such a pre-cleaning requires a complex chemical etching in potassium ferricyanide, boiling KOH, HCL solutions and the like in attempting to remove glass and other debris from the surface of a metal feature to be plated, including contaminates such as metal oxide film.

Additionally, post-cleaning requires hand scrubbing with a brush. In the post-cleaning operation, two concerns are present. First, alumina particles that float to the surface of the nickel film as it is being deposited, must be removed. Secondly, extraneous nickel coated refractory metal particles that are distributed and loosely adhered to the ceramic surface where they are considered to be a defect, must be removed. The conventional method attempts to resolve these two concerns by hand scrubbing.

Thus, the conventional pre-cleaning method for DPN uses chemical etching and processing requiring expensive and environmentally-unfriendly chemicals. Further, the hand scrubbing is cumbersome, tedious, and prevents high yield. Hence, the pre-cleaning and post-cleaning steps require very labor-intensive processes and/or complex procedures and materials, thereby increasing costs and reducing yield.

SUMMARY OF THE INVENTION

In view of the foregoing and other problems of the conventional methods and structures, it is a purpose of the present invention to provide a method and system in which, for a DP metal (e.g., nickel or nickel alloy)-plated substrate pre-cleaning and post-cleaning process, the process steps are reduced, costs are decreased, and expensive or environmentally-unfriendly chemical processes are not required.

Another purpose is to provide a method in which the resulting products have better performance and enhanced reliability.

Yet another purpose is to provide a method and system for cleaning a metal coating by using slurry blasting of substrates both before and after the DPN plating process. The DPN process is a unique operation with specific attributes that are different than standard plating processes.

In one aspect of the present invention, a method of cleaning an object containing a metal surface, includes steps of pre-cleaning the object to prepare the object for a metal plating thereover, and post-cleaning the object after the object has been plated with the metal plating, wherein the pre-cleaning step and the post-cleaning step each include a step of blasting the object with a media.

In another aspect of the present invention, a system for cleaning a substrate having a metal feature, includes a blasting station for blasting the substrate with a slurry prior to and after a dry process metal plating process of the substrate.

In yet another aspect of the invention, a method of processing a substrate including a surface having a terminal refractory metal feature thereon for being plated with a metal, includes steps of: pre-cleaning the substrate, the substrate having any of a plurality of contaminates including organic residue, extraneous refractory metal particles, ceramic debris, and glass, wherein after the pre-cleaning step, the surface is substantially devoid of surface glass and organic debris, the ceramic particles being present embedded in a surface of the terminal refractory metallic feature and extraneous refractory metal particles remaining distributed over the surface of the substrate; performing a dry process nickel plating on the terminal refractory metal feature on the surface of the substrate, wherein extraneous refractory metal particles are plated with nickel plating to form plated extraneous metal particles, and wherein the terminal metallic feature of the substrate plated with nickel is littered with ceramic particles that have floated to the surface of the deposited nickel film during plating; and post-cleaning the surface of the substrate by blasting the surface with a media blast so as to substantially remove the plated extraneous metal particles and the ceramic particles on the plated metal terminal, the metal features being substantially free of oxide.

With the unique and unobvious aspects of the present invention, substrates to be plated using a DP nickel plating technique can be pre-cleaned, prior to plating, and can be post-cleaned, after plating, by using a media blast process. Such a process maintains or improves substrate quality and reliability while decreasing the overall cost of the process and using fewer environmentally unfriendly chemicals. Thus, media blasting is employed and replaces both traditional pre-cleaning and post-cleaning procedures, and is more environmentally-friendly. Media blasting is a much lower cost process and produces improved product performance and increased yields in manufacturing.

BRIEF DESCRIPTION OF THE DRAWINGS

The foregoing and other purposes, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
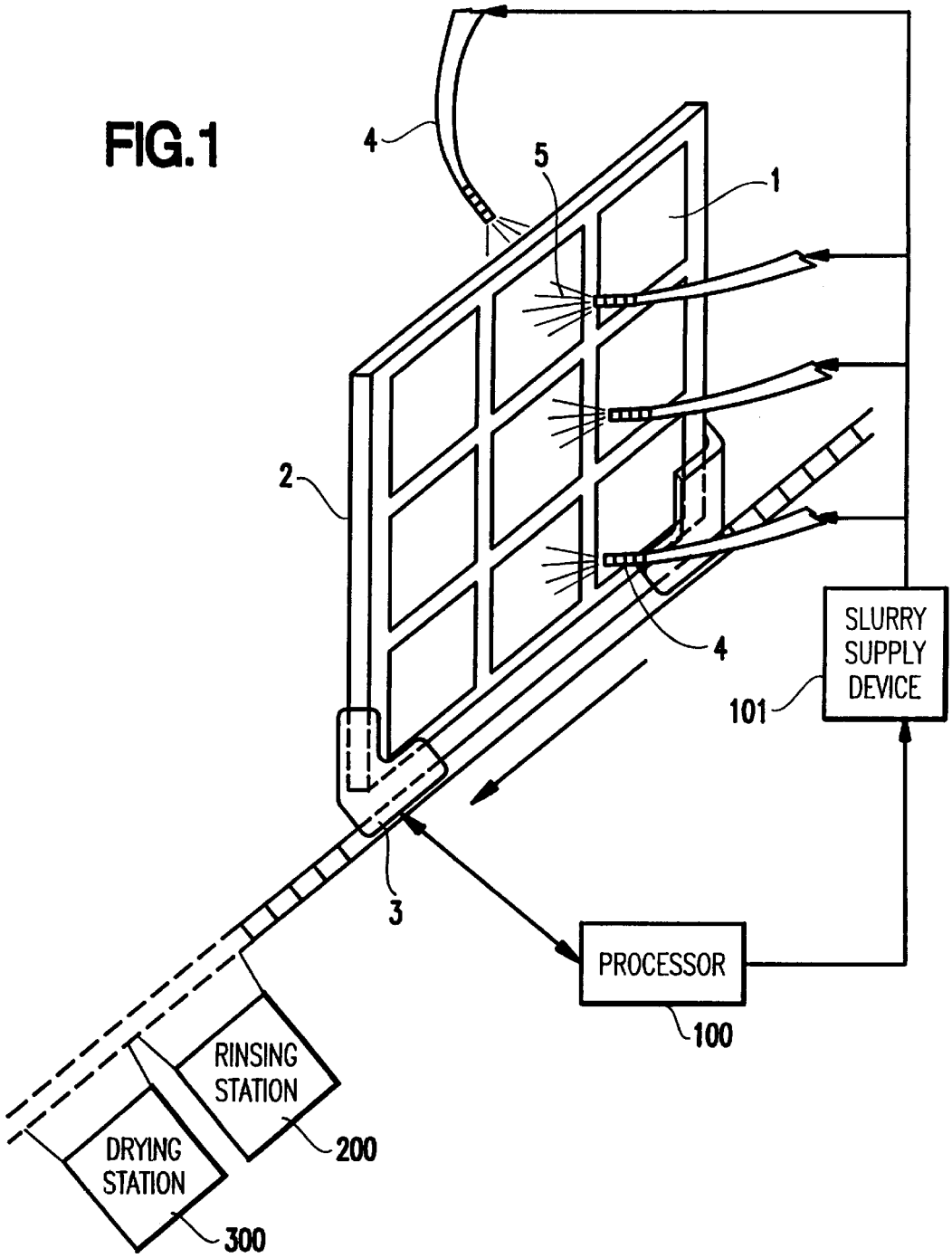
FIG. 1 illustrates a typical media blast set-up and environment according to the present invention.
Figures 2A, 2B, 2C, 2D:
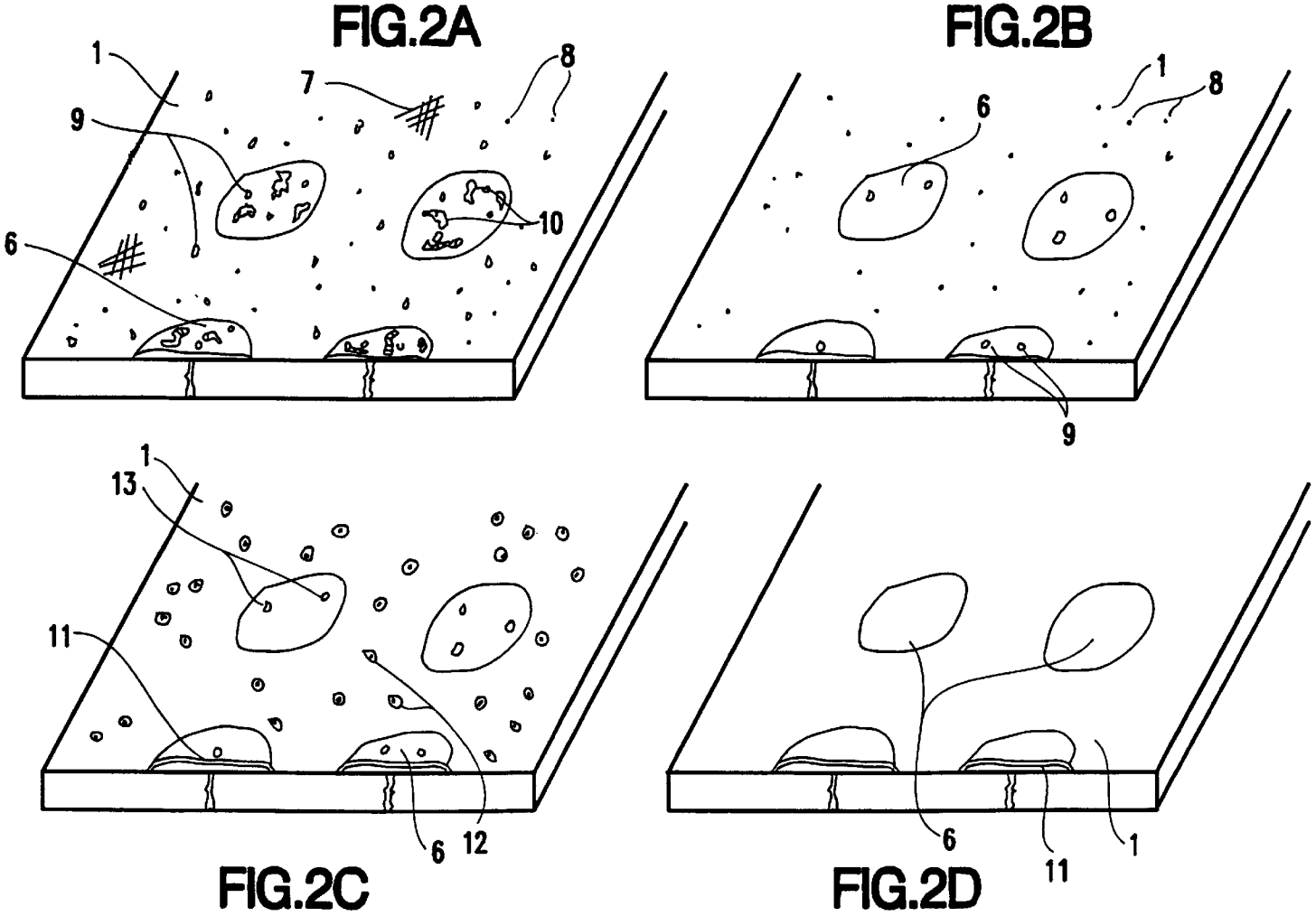
FIGS. 2(A)–2(D) illustrate schematically processing steps for a substrate surface according to a method of the present invention, including the initial substrate, the substrate after a pre-cleaning operation according to the present invention, the substrate after DP nickel plating, and the substrate after a post-cleaning operation according to the present invention.

Referring now to the drawings, and more particularly to FIGS. 1–2(D), there is shown a preferred embodiment of the method according to the present invention. It is noted that the present invention is optimized for the dry process (DP) nickel plating described above, but may find similar utility and benefit in other traditional processes as well.

Generally, the present invention provides a pre-cleaning and post-cleaning method of objects containing refractory metal surfaces (e.g., preferably ceramic substrates used to package semiconductors), for plating in a DP plating process (e.g., preferably a metal such as a nickel or nickel alloy DP plating process), by using a media blast.

In the present invention, the media blast is used in lieu of other conventional pre-cleaning and post-cleaning steps (e.g., chemical etching as a pre-cleaning step to remove extraneous refractory metal particles, and hand scrubbing post-DP nickel plating for removal of ceramic particles and other contaminates).

The present inventors have discovered (and take advantage of) two key technical differences between the electroless nickel boron or nickel phosphorous and the DP nickel plating process.

First, the DP nickel plating process will not bridge between metallic features nearly as readily as the electroless nickel boron or nickel phosphorous process. Along these lines, the DP nickel plating process tends to plate more vertically than horizontally.

Secondly, the DP nickel plating process causes some chemical exchange with the refractory metal being plated. That is, some of the underlying refractory metal is incorporated into the nickel film plated thereover. The nickel is actually alloyed with the refractory metal. In contrast, the other traditional plating processes are not exchange reactions, and will merely (e.g., only) cover or coat the substrate metal being plated with a substantially pure nickel film. There is no exchange reaction or activity between the nickel and the underlying refractory metal in the conventional processes. Thus, there will be substantially no alloying at the interface or otherwise in the traditional plating processes.

Consequently, with the first difference described above, the extraneous refractory metal particles may be allowed to remain on the surface of the substrate during DP nickel plating and not obtain bridging of the nickel film particle-to-particle in any significant manner as normally would occur with electroless nickel boron or nickel phosphorous if the particles were present on the substrate surface during plating.

With the second difference, the extraneous particles themselves are partially physically consumed by the plating of nickel in the DP nickel plating process such that they become significantly less bonded or adhered to the pores of the ceramic substrate. Additionally, due to the plating of the extraneous particles, the particles can "grow" to several times their original volume by the addition of the nickel. Thus, each extraneous particle develops a much higher physical profile. The present inventors have discovered that the overall result of these combined phenomena is that these extraneous (e.g., now metal alloy) particles can be removed after plating by simply treating the substrate surface with a media blast exposure after the DPN process.

Therefore, the media blast pre-cleaning step removes glass, and metal oxide, and carbonaceous residue, as well as other contaminates, but it will not remove extraneous metal particles embedded in the ceramic surface.

However, media blast post-DP nickel plating removes the loosened. and enlarged extraneous metal particles. Additionally, it removes the alumina particles that "float up" on the metallic features during the DP nickel plating process, and helps remove additional stains and carbonaceous residue on the parts. Finally, the media blast post-DP nickel plating removes any metal oxide films, and the substrate is made ready for post-plating process steps.

Hence, with the present invention, the application of media blast both before and after the DP nickel plating process reliably cleans the substrates being plated with dry process nickel. Moreover, the present invention reliably removes extraneous metal, glass, ceramic particles such as alumina particles, carbonaceous residues, and metal oxide films, as well as other various contaminates, and prepares the substrates for subsequent processing.

Furthermore, these advantages of the present invention are accrued while maintaining or improving the quality and reliability of the substrates being plated. For example, the automated processes described below lead to better uniformity than the conventional methods since substantially the same process occurs every time and the non-uniformities of, for example, hand-scrubbing during in the post-cleaning step, are avoided. Simultaneously, the present invention greatly reduces manufacturing costs. For example, for many parts produced, the inventive cleaning method saved 30–70% of the manufacturing costs incurred using the conventional cleaning methods for the same parts. The cost savings are different depending on the application (e.g., the part produced).

Further, the present invention minimizes (or eliminates) the use of chemicals, especially environmentally-unfriendly chemicals, as compared to the conventional processes. Thus, not only is the inventive process and system less costly in terms of manufacturing costs by having less complex steps, but also is less costly in terms of plant and equipment required, and for these and other reasons the media blast is much cheaper than the chemicals employed in traditional processes. Specifically, the media blast is less costly in terms of its direct cost (e.g., lower purchase price than chemicals) as well as indirectly (e.g., costs of handling and disposal as discussed below).

Moreover, the cost of handling and disposal of the spent chemicals under tight regulations imposed by federal agencies (e.g., Environmental Protection Agency, Occupational Safety and Health Agency, etc.) and similar state agencies is not incurred with the inventive process. Indeed, as described below in further detail, the media blast preferably includes silica (e.g., sand) or alumina (e.g., found in the earth's crust). Thus, unlike harsh environmentally-unfriendly chemicals used in the conventional methods, there are no stringent parameters or conditions regarding the disposal of the media blast. It is simply replenished periodically as necessary.

Turning now to the drawings, FIG. 1 shows a typical media blasting system/station where one or more ceramic substrate 1 having metal (e.g., refractory metal) features, are configured into a fixture 2 to hold the substrates 1. The exemplary fixture 2 is designed to hold a plurality of substrates in predetermined positions thereon, however for larger substrates 1, the fixture 2, could be designed to securely hold a single substrate 1.

As would be evident to one ordinarily skilled in the art taking the present specification as a whole, the fixture 2 could be designed to have any shape and configuration with suitable design modifications. It is noted that while FIG. 1 illustrates the pre-cleaning set-up, the post-cleaning station is substantially similar thereto, or the same station could be utilized for both pre-cleaning and post-cleaning.

The fixture 2 holding the substrates 1 can be moved by a suitable transport mechanism 3 (e.g., an endless-belt conveyor 3 or the like) through an area or environment of intense slurry blasting. Slurry 5, which includes the media blast, is ejected through one or more output 4 (e.g., nozzles 4) at a suitably high pressure. For example, the pressure may be substantially within a range of about 30–100 p.s.i., with 40 p.s.i. being preferably in one application of the present invention.

Media blast includes, for example, a fine ceramic powder such as silica or alumina suspended in water or similar aqueous solution, to form a slurry. Preferably, the powder has a particle size substantially within a range of about submicron size (e.g., 0.1 $\mu$m to 20 $\mu$m). In one exemplary application, 1250 mesh silica (e.g., silica having a particle size on the order of about 7 $\mu$m) was employed. As mentioned above, the slurry is preferably pumped to a pressure substantially within a range of about 30 to 100 p.s.i. (and more preferably to 40 p.s.i. in one application), and is sprayed onto the surface of the ceramic substrate to be cleaned. Media blast is commercially available from a plurality of sources, or can be easily fabricated according to the designer's requirements and operating conditions.

Preferably, the system, including the movement and positioning of the fixture 2 by the transport mechanism 3, the sensing of the position of the fixture 2 opposite the nozzles 4, the activation of the nozzles 4, etc., and subsequent movement of the fixtures through various precessing stations nozzles (e.g., through plating and subsequent post-cleaning), is computer-controlled by a processor, a numerically-controlled machine (NCM), or the like 100. The nozzles 4 are connected to a pressurized slurry supply device 101, and the slurry may be either continuously or selectively ejected into the output nozzle 4, depending upon operator's desires.

Typically, the nozzles 4 are maintained stationary at convenient, predetermined positions and locations within the system and consistent with fixturing detail. Such positioning ensures complete coverage of every substrate (and every portion of every substrate) that travels through the system. By the same token, the fixture 2 could be designed to be stationary at a predetermined position, with the nozzles and slurry supply being portable/movable, as would be known by one or ordinary skill in the art within the purview of the present application.

As shown, blasting is usually performed from a plurality (e.g., first and second) sides simultaneously to effect efficient processing of substrates 1.

After passing through the slurry impingement area of the blast apparatus, the fixture 2 containing the substrates 1 is transported through a rinsing station 200 (shown schematically) ) to be rinsed with water, or other rinses depending upon the application, and a drying station 300 (also shown schematically in FIG. 1) for blowing the substrate with compressed gas (e.g., air, nitrogen, or the like) to remove excess water and to dry the substrate 1.

FIGS. 2(A)–2(D) are schematic representations of the surface of a substrate 1 at various processing steps of the inventive system and method.

FIG. 2(A) illustrates the initial substrate 1 before processing. The substrate 1 may have, for example, a plurality of terminal refractory metal features 6 (e.g., input/output (I/O) pads 6). As shown, various contaminates are present on the substrate surface including organic (e.g., carbonaceous) residue 7, extraneous refractory metal particles 8, ceramic debris 9, glass 10, etc.

FIG. 2(B) shows the substrate 1 after the pre-cleaning media blast step. As compared to FIG. 2(A), surface glass 10 and organic debris 7 have been removed, but some of the ceramic particles 9 are still present and may be embedded in the surface of the terminal refractory metallic features (e.g., I/O pads 6). Additionally, some of the extraneous refractory metal particles 8 have not been removed by the pre-cleaning, but remain distributed over the surface of the substrate 1.

FIG. 2(C) depicts the substrate's condition after DP nickel plating, in which the extraneous refractory metal particles 8 have been plated with nickel plating film 11 (e.g., to form plated extraneous metal particles 12) and have become greatly enlarged. Additionally, the terminal metallic features (e.g., I/O pads 6) of the substrate 1 have been plated with nickel 11, but they are also littered with ceramic particles that have been floated to the surface of the deposited nickel film (e.g., "floated" ceramic particles 13) during plating.

Finally, FIG. 2(D) shows the final surface condition of the substrate 1 after post-cleaning media blast of the substrate surface. As shown, the extraneous metal particles 12 and the undesired ceramic particles 13 on the plated metal terminals (e.g., I/O pads 6) have been removed. Thus, the metal features 6 are essentially free of oxide, and the substrate 1 is ready for post-plating processing. It is noted that the same type or a different type of media blast may be employed in the pre-cleaning and post-cleaning steps depending upon the designer's requirements and constraints.

Thus, with the unique and unobvious features of the claimed invention, a media blast is used in lieu of other conventional pre-cleaning and post-cleaning steps such as chemical etching as a pre-cleaning step to remove extraneous refractory metal particles, and hand scrubbing post-DP nickel plating for removal of ceramic particles and other contaminates.

Moreover, by using a unique combination of blasting steps before and after plating of metal features with a deposited metal (e.g., nickel), contaminates may be reliably removed easily, simply, and inexpensively, without any hazardous and environmentally unfriendly (and thus costly to dispose of) chemicals. Thus, costs are saved not only during the manufacturing process but also in the post-process handling and disposal of process by-products, such as spent chemical waste.

Specifically, the media blast pre-cleaning step removes glass, and metal oxide, and carbonaceous residue, as well as other contaminates, whereas the post-plating blast removes the loosened and enlarged extraneous metal particles embedded in the ceramic surface and the alumina particles that "float up" on the metallic features in the DP nickel plating process, and helps remove additional stains and carbonaceous residue on the substrate surface, as well as any metal oxide films. Furthermore,. the present invention minimizes the use of chemicals, especially hazardous and environmentally-unfriendly chemicals, as compared to the conventional processes.

While the invention has been described in terms of a single preferred embodiment, those skilled in the art will recognize that the invention can be practiced with modification within the spirit and scope of the appended claims.

What is claimed is:

1. A method of processing a substrate including a surface having a terminal refractory metal feature thereon for being plated with a metal, comprising:

pre-cleaning said substrate, said substrate having any of a plurality of contaminates including organic residue, extraneous refractory metal particles, ceramic debris, and glass, wherein after said pre-cleaning, said surface is substantially devoid of surface glass and organic debris, ceramic particles of said ceramic debris being present embedded in a surface of the terminal refractory metal feature and extraneous refractory metal particles remaining being distributed over the surface of the substrate;

performing a dry process metal plating on said terminal refractory metal feature on the surface of said substrate, wherein extraneous refractory metal particles are plated with the dry process metal plating to form plated extraneous metal particles, and wherein the refractory terminal metal feature of the substrate plated with metal is littered with ceramic particles having floated to the surface of deposited metal plating during plating; and post-cleaning said surface of said substrate by blasting said surface with a media blast so as to substantially remove the plated extraneous metal particles and the ceramic particles on the plated terminal refractory metal feature, said metal feature being substantially free of oxide.

2. The method according to claim 1, wherein said dry process metal plating process comprises one of a dry process nickel plating process and a dry process nickel-alloy plating process, and wherein said method is devoid of use of a chemical in either of said pre-cleaning and said post-cleaning.

3. The method according to claim 2, wherein said media blast comprises a ceramic powder suspended in an aqueous solution to form a slurry.

4. The method according to claim 3, wherein said ceramic powder comprises at least one of silica and alumina.

5. The method according to claim 4, wherein said at least one of silica and alumina has a particle size substantially within a range of about 0.1 $\mu$m to about 20 $\mu$m.

6. The method according to claim 5, wherein said silica comprises about 1250 mesh silica.

7. The method according to claim 3, further comprising pumping said slurry to a pressure of about 30 to about 100 psi and spraying said slurry onto the surface of the ceramic substrate to be cleaned.

8. The method according to claim 1, wherein said pre-cleaning is devoid of a chemical etching and said post-cleaning is devoid of hand scrubbing.

9. The method according to claim 2, wherein said blasting of said pre-cleaning is for removing glass, metal oxide, and carbonaceous residue from said substrate, said blasting of said pre-cleaning leaving extraneous metal particles embedded in the ceramic surface of said object.

10. The method according to claim 2, wherein said blasting of said post-cleaning is for removing extraneous metal particles loosened and enlarged by plating of said feature, alumina particles floated up on the metal surface during the dry process metal plating process, carbonaceous residue on the object, and a metal oxide film.

11. A method of cleaning an object containing a metal plating, comprising:

pre-cleaning said object to prepare said object for a metal plating thereover;

forming said metal plating on said object; and post-cleaning said object after said forming of said metal plating on said object, wherein said pre-cleaning and said post-cleaning each comprise blasting said object with a media, and wherein said object includes a ceramic substrate containing a refractors metal feature for plating in a dry process metal plating process.

12. The method according to claim 11, wherein said metal feature is plated with one of a nickel and a nickel alloy in the dry process metal plating process, wherein said method is devoid of use of a chemical in either of said pre-cleaning or said post-cleaning.

13. The method according to claim 12, wherein said media comprises a ceramic powder suspended in an aqueous solution to form a slurry.

14. The method according to claim 13, wherein said ceramic powder comprises at least one of silica and alumina.

15. The method according to claim 14, wherein said at least one of silica and alumina has a particle size substantially within a range of about 0.1 $\mu$m to about 120 $\mu$m.

16. The method according to claim 15, wherein said silica comprises about 1250 mesh silica.

17. The method according to claim 13, pumping said slurry substantially to a pressure of about 30 to about 100 psi and spraying said slurry onto the surface of the ceramic substrate to be cleaned.

18. The method according to claim 11, wherein said pre-cleaning is devoid of a chemical etching and said post-cleaning is devoid of hand scrubbing.

19. The method according to claim 11, wherein said blasting of said pre-cleaning is for removing glass, and metal oxide, and carbonaceous residue from said object, said object including a ceramic surface, extraneous metal particles embedded in the ceramic surface of said object remaining in the surface after said blasting of said pre-cleaning.

20. The method according to claim 11, wherein said blasting of said post-cleaning is for removing extraneous metal particles loosened and enlarged by plating of said object, alumina particles floated up on the metal surface during the dry process metal plating process, a carbonaceous residue on the object, and a metal oxide film, said metal plating comprising a dry process metal plating process.

21. The method according to claim 11, wherein said pre-cleaning is separated from said post-cleaning by the metal plating, said metal plating comprising a dry process nickel (DPN) plating of said object.

22. A method of cleaning an object containing a metal plating, comprising:

pre-cleaning said object to prepare said object for a metal plating thereover;

forming said metal plating on said object; and post-cleaning said object after said forming of said metal plating on said object, wherein said pre-cleaning and said post-cleaning each comprise blasting said object with a media, and wherein said post-cleaning removes from said object extraneous metal, glass, ceramic particles including alumina particles, a carbonaceous residue, and a metal oxide film.

* * * * *